US007341218B2

(12) United States Patent
Tellier et al.

(10) Patent No.: US 7,341,218 B2
(45) Date of Patent: Mar. 11, 2008

(54) COOLED MANDREL FOR WINDING A STRIP PRODUCT

(75) Inventors: Dominique Tellier, Saint Etienne (FR); Jean Perret, Montbrison (FR)

(73) Assignee: Siemens VAI Metals Technologies SAS, Saint Chamond (FR)

( * ) Notice: Subject to any disclaimer, the term of this patent is extended or adjusted under 35 U.S.C. 154(b) by 101 days.

(21) Appl. No.: 10/532,340

(22) PCT Filed: Oct. 23, 2003

(86) PCT No.: PCT/FR03/03144

§ 371 (c)(1),
(2), (4) Date: Apr. 22, 2005

(87) PCT Pub. No.: WO2004/037456

PCT Pub. Date: May 6, 2004

(65) Prior Publication Data

US 2006/0043231 A1 Mar. 2, 2006

(30) Foreign Application Priority Data

Oct. 23, 2002 (FR) ..... 02 13257

(51) Int. Cl.
*B65H 75/24* (2006.01)

(52) U.S. Cl. ..... 242/573.7; 242/909

(58) Field of Classification Search ..... 242/571, 242/573, 573.7, 576.1, 909, 572, 573.2, 573.3, 242/573.5, 573.6, 573.9; 279/2.11, 2.12, 279/2.13, 2.14, 2.15
See application file for complete search history.

(56) References Cited

U.S. PATENT DOCUMENTS

| | | | | |
|---|---|---|---|---|
| 3,104,849 A * | 9/1963 | Bond | ..... | 242/573.2 |
| 3,666,194 A * | 5/1972 | Gosnell | ..... | 242/573.8 |
| 3,754,720 A | 8/1973 | Gross, et al. | | |
| 5,996,929 A * | 12/1999 | Mazodier et al. | ..... | 242/573.7 |

FOREIGN PATENT DOCUMENTS

| | | |
|---|---|---|
| FR | 1 284 714 A | 2/1962 |
| FR | 2 761 964 A | 10/1998 |
| FR | 2761964 A1 * | 10/1998 |
| GB | 1 531 410 A | 11/1978 |
| GB | 1531410 A * | 11/1978 |

* cited by examiner

*Primary Examiner*—Peter M. Cuomo
*Assistant Examiner*—William E Dondero
(74) *Attorney, Agent, or Firm*—Arent Fox LLP

(57) ABSTRACT

A cooled mandrel for winding a band-type product into a coil, including a set of adjacent segments mounted to slide radially on a central shaft and fitted each of a cooling circuit having two orifices, respectively an inlet orifice and an outlet orifice, connected each, by a connection fitting having a variable length, to a supply or exhaust duct, respectively of a heat exchanging fluid. The linking fittings corresponding to each segment are connected to a distribution part threaded on a lateral face of the shaft, wherein both ducts emerge transversally, respectively of the supply duct and the exhaust duct, which are arranged inside the central shaft.

25 Claims, 4 Drawing Sheets

COOLED MANDREL FOR WINDING A STRIP PRODUCT

The invention relates to a cooled mandrel for winding a band-type product into a coil, in particular a metal band.

The invention applies especially to the winding of thin continuous-cast band, but may be used, generally, for the winding into a coil of any band at high temperature, liable to disturb the operation of the mandrel.

In metallurgical plants, in particular rolling plants or metal band processing plants, it is often necessary, at the outlet of a portion of the plant, to wind the band into a coil in order to transport it easily towards another portion of the plant or any other processing station.

To do so, a winder is used, comprising a mandrel composed of a cylindrical bar driven into rotation around its axis and fitted with means for fastening the end of the band which winds then into a coil on the cylindrical bar.

Generally, the winding bar has a variable diameter and may be retracted to enable the removing of the coil after winding.

To this end, the mandrels used conventionally are of the type comprising a supporting shaft centred on an axis and associated with rotational driving means, and a plurality of circular segments forming together substantially cylindrical a surface and attached to the central supporting shaft with a possibility of radial displacement in order to enable the variation in diameter of the cylindrical surface thus composed and whereon is wound the band.

To control the variation in diameter of the mandrel, one uses conventionally a rack-type device, comprising a control part sliding axially on the central shaft and whereon is arranged, for each segment, at least one conical portion co-operating with at least one mating tilted face arranged on an internal face of segment, which may thus move away from or come closer to the central shaft by longitudinal displacement of the control part under the action of an expansion rod mounted slidingly axially in a bore of the central shaft.

For correct operation of the mandrel, the different part in relative motion should be able to move with minimum friction. Lubrication of the contact surfaces of the parts in relative motion is therefore dedicated to this end.

Until now, such mandrels have been used essentially in rolling plants and the holding time of a coil on a mandrel is then rather limited and does not exceed 5 to 6 minutes, for instance. Even when the rolled band is hot, such a holding time does not raise, normally, any thermal problems liable to disturb the operation of the mandrel.

For some time, however, it has been sought to develop new continuous casting technologies for very thin bands and it may be interesting, to wind such a band into a coil on a mandrel.

Still, shortly after casting, the band is still at high temperature and, on the other hand, the winding time and, consequently, the holding time of the coil on the mandrel may be long since it is linked to the casting speed which is, obviously, much slower than that encountered in rolling plants.

Still, the mandrels used conventionally may not sustain such a heat transmission, by reason of the thermal effects, in particular constraints and dilatations of the different parts, liable to disturb the operation.

To solve this problem, the applicant company has suggested, recently, to realise a mandrel whereof the winding surface may be cooled by circulating a heat exchanging fluid.

In such an arrangement, described in the document FR-A-2,761,964, the external face of each segment is composed of a curved plate, relatively thick, inside which is provided a cooling circuit having an inlet orifice and an outlet orifice connected respectively to a supply duct and to an exhaust duct arranged at least partially, inside the central shaft whereon are mounted the segments. To enable the expansion and the retraction of the mandrel by radial sliding of the segments, the inlet and outlet orifices of the fluid are connected each, by a ductile fitting, to a chamber, respectively a supply chamber or an exhaust chamber, wherein emerges the corresponding duct.

In the arrangement of the document FR-A-2,761,964, the supply and exhaust chambers connected respectively to each segment are arranged in a fluid box attached to a front end of the central shaft which, usually, is mounted rotatably on a supporting chassis and extends cantilever from a rear end whereon is applied a rotational driving torque.

However, as already stated, the radial displacement of the segments for the expansion or the retraction of the mandrel is controlled usually by a tubular part mounted slidingly on the central shaft of the mandrel and whereof the displacement, in one direction or in the other, is determined by a control expansion rod mounted slidingly axially in a bore of the central shaft. The tubular part must therefore be connected to this control rod by a linking part which runs before the front end of the central shaft and may be displaced alternately in one direction or in the other for controlling the expansion or the retraction of the segments. However, the latter may not move in the longitudinal direction and the same goes for the water box which, in the arrangement of the document FR-A-2,761,964 is connected to each segment by ductile fittings whereof the length may vary radially. It is therefore necessary to provide, between this water box and the front end of the central shaft a space enabling the displacement of the part linking with the expansion rod and the supply and exhaust ducts arranged inside the central shaft should therefore be connected to the corresponding chambers of the water box by ductile or sliding connection means.

It is therefore rather difficult, in such an arrangement, to guarantee the tightness of the cooling circuit. Moreover, the segments are prolonged beyond the front end of the central shaft in order to provide a housing wherein is placed the water box, the latter being connected to the end of the central shaft by rods going through the linking part to enable the displacement axial thereof. Still, the ductile linking fittings between each segment and the water box exert thereon, in the radial direction, significant loads, and which are not always equal. Moreover, in a metallurgical plant, in particular a continuous casting plant, the mandrel may be subjected to shocks and the water box, thus placed at the end of the mandrel forms rather brittle a member.

The purpose of the invention is to solve such problems, while keeping the advantages of the cooled mandrel described in the document FR-A-2,761,964, thanks to a simpler arrangement of the cooling circuit enabling, besides, better protection of the supply and exhaust members of the heat exchanging fluid.

Besides, the invention facilitates the disassembly of the mandrel for maintenance purposes and also enables to guarantee simply the lubrication of the different parts in relative motion.

The invention applies therefore, generally, to a cooled mandrel for winding a product into a band comprising a central shaft extending between a rear end connected to rotational driving means round an axis and a front end, and a set of adjacent segments mounted to slide radially on said shaft and having curved external faces which connect to form substantially cylindrical a winding surface centred on the axis of the central shaft, means for controlling a variation in diameter of the winding surface, by radial sliding of said segments, between an expanded position and a retracted position, and means for cooling the surface of each segment by circulating a heat exchanging fluid comprising, for each segment, a cooling circuit arranged inside said segment and having an inlet orifice and an outlet orifice of the heat exchanging fluid connected each, by means of a deformable fitting, to a fluid supply or exhaust duct, respectively.

According to the invention each supply or exhaust duct, respectively is arranged, at least partially, inside the central shaft and is fitted, close to the front end thereof, with a bent portion extending transversally to the longitudinal axis (X', X) of the central shaft and emerging on a lateral face of said shaft by a supply or exhaust transversal orifice, respectively, which is connected sealingly, by at least one fitting of variable length, to at least one inlet or outlet orifice, respectively, of at least one segment.

According to another particularly advantageous characteristic of the invention, the fittings linking with the inlet and outlet orifices of each segment are attached to a distribution part in the form of a ring having a concave internal face threaded sealingly on a smooth bearing surface of the lateral face of the central shaft, whereon are provided at least two internal orifices which, in the threaded position of the distribution part, are aligned each with a supply or exhaust transversal orifice, respectively, opening onto said bearing surface of the central shaft, in order to form substantially watertight a connection, and an external face whereon are provided, for each segment, two external orifices, respectively a supply orifice and an exhaust orifice, associated each to a means for connecting a fitting linking with an inlet or outlet orifice, respectively of the corresponding segment, each external orifice, respectively the supply orifice or the exhaust orifice, being connected to an internal orifice, respectively supply or exhaust, by at least one channel arranged, at least partially, in the distribution part.

In a preferred embodiment, the mandrel comprises for each segment, a pair of ducts, respectively a supply duct and an exhaust duct, arranged inside the central shaft and emerging respectively, on the smooth bearing surface of the shaft, by a pair of transversal orifices, both external orifices, respectively the supply orifice and the exhaust orifice, corresponding to each segment are connected by two channels arranged in the distribution part, to two internal orifices, respectively the supply orifice and the exhaust orifice, and the pairs of internal orifices corresponding to the different segments are distributed, along the internal face of the distribution part, similarly to the pairs of transversal orifices on the smooth bearing surface of the shaft, so that, in the threaded position of the distribution part, each internal orifice, respectively the supply orifice or the exhaust orifice, lies in the extension of a transversal orifice connected to a duct, respectively the supply duct or the exhaust duct, of the central shaft.

The mandrel comprising a number (n) of segments centred on radial planes distributed starwise around the axis, the central shaft is therefore fitted with (n) pairs of ducts, respectively supply and exhaust ducts, extending symmetrically on both sides of each radial medial plane and emerging each into the smooth bearing surface of the shaft by a transversal orifice having an axis parallel to said radial medial plane and the internal and external orifices of the distribution part are distributed by symmetrical pairs with respect to the radial medial plane of each segment and have axes parallel to said radial medial plane and aligned with the axes of each corresponding pair of transversal orifices of the smooth bearing surface of the central shaft.

Particularly advantageously, the smooth bearing surface of the central shaft and the mating internal face of the distribution part are in the form of cylinders whereof the revolution is centred on the axis of the central shaft and having the same diameter, within the assembly clearance, the distribution part being threaded slidingly on the smooth bearing surface of the shaft with interposition of at least two circular sealing joints on both sides of the aligned orifices.

In such a case, the external face of the distribution part includes, preferably, a plurality of connection facets, of number equal to the number (n) of segments, fitted each with a pair of external orifices, respectively supply and exhaust orifices, connected to a pair of orifices, respectively inlet and outlet orifices, of the corresponding segment, by a pair of fittings of variable length having each an internal end and an external end attached, respectively, on a facet of the distribution part and on a connection facet of the segment whereon are provided the inlet and outlet orifices of the fluid.

Each fitting of variable length may advantageously be composed of a tubing of ductile material, such as an elastomer.

In a manner known in itself, the radial sliding of the segments is controlled by a rack-type device including a tubular sheath mounted to slide axially on the central shaft between two positions, respectively a retracted position and an extended position, and connected to a control rod mounted slidingly in an axial bore of said shaft, by a linking member extending transversally before the front end of the central shaft.

According to another particularly advantageous characteristic of the invention, the tubular sheath whereon are arranged the tilted faces controlling the radial sliding of the segments extends substantially, in its forward position, up to the insertion bearing surface of the distribution part, and is prolonged, beyond the latter, by at least two arms running each between two pairs of linking fittings between the distribution part and both corresponding adjacent segments, in order to be attached, by a front end, to the transversal member linking with the control rod of the sliding.

The mandrel comprising (n) segments surrounding the central shaft, the distribution part comprises itself (n) lateral watertight connection facet, each for a pair of linking fittings, between which are arranged (n) slipping faces forming each a sliding rest on an arm controlling the tubular sheath.

Preferably, the external face of the distribution part is substantially polygonal in shape, the lateral connection facet of the fittings being planar.

According to a preferred characteristic, the transversal linking member between the control rod and the sheath is composed of a massive part, fitted with a central recess which, at least in a rear position of the control rod, is mounted on a centring bearing surface, arranged between the front end of the central shaft and the insertion bearing surface of the distribution part.

In certain cases, the linking member may advantageously be prolonged, towards the front, by a protruding portion forming an axle journal centred on the axis of the central shaft and liable to rest, by means of a bearing, on a fixed portion. Thus, instead of extending cantilever from the supporting chassis, the central shaft may rest, by removable means, on a fixed portion, which enables to avoid the flexion of the central shaft and to guarantee correct winding of the spires over one another.

On the other hand, the utilisation, according to the invention, of a tubular sheath connected to the transversal member linking with the sliding control rod by arms running between the linking fittings, enables to implement a very simple lubrication system of the parts in motion.

Indeed, according to a particularly advantageous arrangement, the mandrel comprises a circuit for lubrication, at least, tilted faces controlling the sliding of the segments comprising, for each tilted face, at least one grease outlet orifice, situated at the exit of a pipework extending along the sheath and prolonged along at least one arm controlling the sliding up to a supply orifice, placed on the front end of said arm and connected, by fastening the linking member on said arm, to a watertight connection tubing, carried by the linking member, and connected to a pressurised grease injection means.

Preferably, each connection tubing of the lubrication circuit is arranged on a rear face of the linking member, whereon applies the front end of the corresponding control arm of the sheath and is placed at the exit of a conduit extending, at least partially, inside the linking member, up to a grease infeed orifice.

For watertight supply of the lubrication circuit, even under high pressure, the front end of the control rod which is centred on the axis of the mandrel is fitted with a cylindrical bearing surface which is inserted into a mating bore arranged at the centre of the linking part and wherein emerges at least a grease inlet orifice connected by a conduit to a connection tubing carried by the linking part, and the control rod is fitted with at least one conduit extending longitudinally between a rear orifice connected to the grease infeed means and a front orifice arranged on the insertion bearing surface of the control rod, and communicating with the grease inlet orifice emerging into the bore of the linking part, after inserting the control rod therein.

Advantageously, the insertion bearing surface of the control rod is fitted with at least one annular groove which, in the inserted position of the control rod, is situated by the grease infeed orifice opening onto the central bore, said groove being surrounded by two annular joints providing the tightness of the connection thus formed.

The invention also exhibits other advantages and covers other characteristics, mentioned in the claims, which will appear in the following description of a particular embodiment, given for exemplification purposes and illustrated by the appended drawings.

Figure 1:
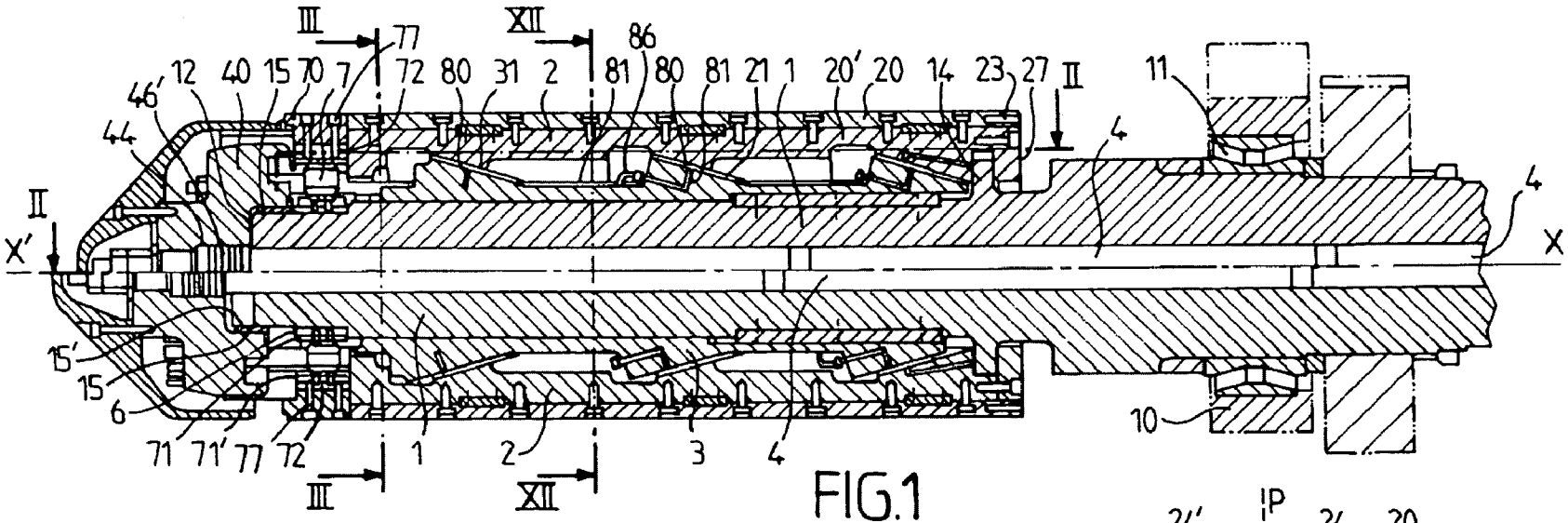
FIG. 1 shows two semi-views in longitudinal section of the mandrel according to the invention, respectively in expanded position at the upper portion and in retracted position at the lower portion.

As indicated, the mandrel according to the invention comprises, generally, a central shaft 1 mounted rotatably on a chassis 10 around two bearings 11 and surrounded by a set of segments 2 mounted to slide radially on the central shaft and having curved external faces which connect tangentially to form a winding cylindrical surface centred on the axis X'X of the shaft; the radial sliding of the segments is controlled by a tubular part in the form of a sheath 3, mounted on the central shaft and fitted with tilted faces 31 which co-operate with corresponding tilted faces 21 of each segment 2 to determine the expansion or the retraction of the mandrel by longitudinal displacement of the tubular sheath 3 between two positions, respectively a retracted position and an expanded position, under the action of an expansion control rod 4 sliding in an axial bore of the central shaft 1 and connected to the tubular part 3 by a transversal linking member 40.

All these arrangements are well known and do not require a detailed description. Consequently, the drawings only show, on FIG. 1, the front portion of the shaft 1 carrying the segments 2 and, on FIG. 7, the rear portion of the shaft 1 whereto are associated rotational driving means not represented on the drawing and a jack 41 controlling the axial sliding of the expansion rod 4.

Besides, the mandrel is of the type described in the previous patent FR-B-2,761,964, comprising means for cooling the winding surface by circulating a heat exchanging fluid inside each segment. To this end, each segment 2 comprises therefore a curved external wall 20, relatively thick, inside which is arranged a cooling circuit 24, 24' comprising an inlet orifice 75 and an outlet orifice 75' connected respectively, by fittings of variable length 7, 7', to supply 5 and exhaust 5' ducts arranged inside the central shaft.

Advantageously, each fitting of variable length 7, 7' is composed of a tubular sleeve of ductile material such as an elastomer, but it would be also possible to use a telescopic assembly.

As seen above, in the arrangement known previously, the ductile fittings were connected to a distribution box placed before the front end of the central shaft and separate therefrom by a space enabling the longitudinal displacement of the linking member, each segment being prolonged beyond the front end of the central shaft in order to provide a housing wherein was placed the distribution box.

In the arrangement according to the invention, conversely, the distribution box of the fluid 6 is mounted on the shaft 1 and comprises a set of channels 65, 65' placed in the alignment of channels 52, 52', arranged radially in the thickness of the central shaft 1 and emerging each, onto the lateral face 13 thereof, by an orifice, respectively a supply orifice 53 or an exhaust orifice 53', said channels 65, 65' being connected, by ductile fittings 7, 7' with the orifices, respectively the inlet orifice 75 or the outlet orifice 75', of the corresponding segment. This distribution box 6 is therefore placed behind the linking member 40 which may move freely under the action of the expansion control rod and the segments 2 extend over a length substantially equal to that of the central shaft.

Figure 5:
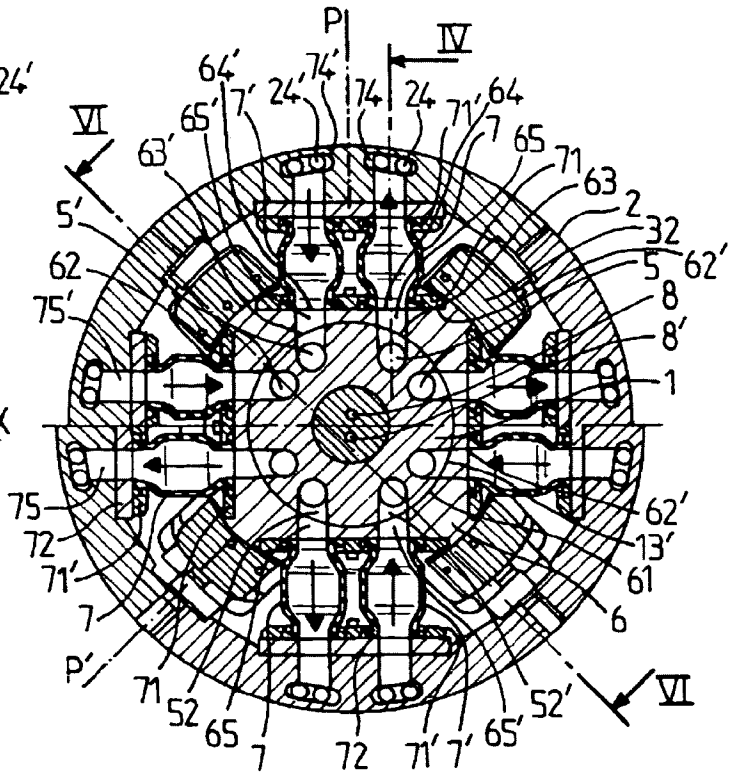
FIG. 5 is a transversal sectional view along the line V-V of FIG. 4, in retracted position at the upper portion and in expanded position at the lower portion.
Figure 4:
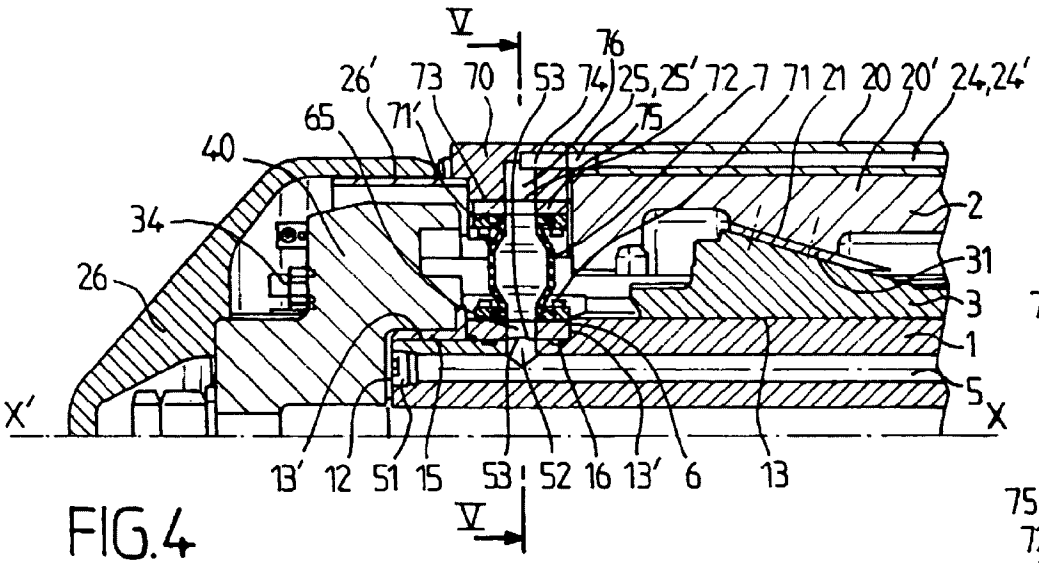
FIG. 4 is a partial semi-view of the front end of the mandrel in longitudinal section along the line IV-IV of FIG. 5.

In particular, in the preferred embodiment represented, on FIGS. 4 and 5, the central shaft 1 is fitted, for each segment 2, with two bores parallel to the axis, which extend over the whole length of the shaft 1 and form respectively a supply duct 5 and an exhaust duct 5' arranged symmetrically on both sides of the medial plane P of the segment 2. In the case, represented on the figure, of a mandrel including four segments each covering a quadrant, the central shaft 1 is hence fitted with four pairs of ducts 5, 5'.

As before, the linking member 40 which is attached to the front end of the expansion control rod 4 extends transversally before the front face 12 of the central shaft 1. However, in the previous arrangement of the French patent 2 761 964, the supply and exhaust ducts arranged in the central shaft should be prolonged by tubings running through the linking member, for connection to the distribution box placed before said member. In the arrangement according to the invention, conversely, the longitudinal bores forming the ducts 5, 5' are sealed, each, by a plug 51, at the front face 12, and communicate with a channel 52, 52' which extends transversally to the axis X'X of the mandrel to emerge via an orifice 53, 53' opening onto a front portion 13' of the lateral face 13 of the shaft 1.

In the preferred embodiment represented on the figures, the lateral face 13 of the shaft 1 whereon is mounted the control part 3 in the form of a tubular sheath is fitted, on its front portion 13', with a smooth bearing surface having a cylindrical revolution section and whereon is mounted a distribution part in the form of a ring 6 having a concave internal face 61 of diameter equal, within the assembly clearance, to that of that smooth bearing surface 13'.

On the other hand, the distribution part 6 is limited by an external face 62 including, for each segment 2, a facet, preferably planar, for fastening ductile linking fittings between the segment 2 and the supply 5 and exhaust 5' ducts. In the four-segment embodiment represented on the figures, the external face 62 of the distribution part 6 has therefore a square section in order to exhibit four planar connection facets, each, with a pair of ductile fittings 7, 7'. For, each segment 2, the distribution ring 6 is fitted, on its internal face 61, with two internal orifices 63, 63' which communicate each with an external orifice 64, 64' arranged on the external face 62, by a channel 65, 65' drilled in the thickness of the ring 6.

Moreover, as shown on FIG. 5, these linking channels 65, 65' between the internal orifices 63, 63' and the external orifices 64, 64' are centred on axes orthogonal to the axis X'X of the shaft 1 and parallel to the medial plane P of the corresponding segment 2 and are thereby aligned, in the threaded position of the ring 6, with the axes of the channels 52, 52' which run through the shaft 1 to communicate with the duct, respectively the supply duct 5 or the exhaust duct 5'.

Preferably, the smooth bearing surface 13' arranged on the front portion of the shaft 1 has a diameter smaller than that of the lateral face 13 thereof in order to former a countersink enabling to insert of the ring-shaped distribution part 6, up to a set position for which the channels 52, 52' of the shaft 1 and 65, 65' of the ring 6 are perfectly aligned, the ring 6 being maintained in this position by a stop 15.

On the other hand, each external orifice 64, 64' of the ring 6 emerges into a deformable fitting 7, 7' attached by a drilled plate forming an internal flange 71 on a corresponding facet 62' of the external face 62 of the ring. Similarly, at their opposite end, both fittings 7, 7' are attached by an external flange 71' to a planar facet 73 arranged on the internal side of a connection part 70 in the form of a circular sector attached to the front end of each segment 2.

Advantageously, an intermediate plate 72 is interposed between the external flange 71' and the connection part 70 of the segment in order to facilitate the disassembly of the segment, as can be seen thereunder.

As usual, each segment 2 comprises an external portion 20 in the form of a cylindrical revolution sector which forms a portion of the winding surface of the band and an internal portion 20' whereon are arranged the tilted faces 21 co-operating with the mating faces 31 of the tubular sheath 3 to control the expansion or the retraction of the mandrel.

In the preferred embodiment represented on the figures, the external portion 20 of the segment 2 is composed of a curved plate in the thickness of which are arranged two series of channels, respectively 24, 24' parallel to the axis X'X of the mandrel and extending, respectively, on both sides of the medial plane P of the segment, said channels being regularly spaced apart in order to cover substantially the whole surface of the segment.

As can be seen on FIG. 4, the front end of the segment 2 is fitted with two circular grooves 25, 25' wherein emerge, respectively, both series of channels 24, 24'. On the other hand, the connection part 70 which is attached, as seen above, to the front end of the curved plate 20, is fitted itself with two oblong holes 74, 74' which open each, on one side onto a portion of the corresponding groove 25, 25' of the segment 2 and on the other side, into a channel 76 arranged in the thickness of the connection part 70 and emerging via an orifice 75, 75' onto the planar facet 73 whereon is applied the external flange 71' for fastening the pair of fitting 7, 7'.

Moreover, as shown on FIG. 1, the rear end of each curved plate 20 is fitted with a circular groove 23 which joins both series of channels 24, 24' and is closed outwardly by a plug.

Conventionally, the shaft is fitted with a transversal flange 14 engaging into a housing arranged at the back of each segment 2 which is maintained by an axial stop 27 with a possibility of radial sliding. Both orifices 75, 75' arranged in the connection part 70 remain therefore aligned with the transversal channels 52, 52' whereto they are connected by the ductile fittings 7, 7' which follow the expansion or retraction movements of the segment.

Inserting the ring 6 on the smooth bearing surface 13' with a simple assembly clearance guarantees a watertight link between the channels 52, 52' and 65, 65', of the annular sealing joints 16 thereby avoiding water leaks inside the mandrel.

Thus, the heat exchanging fluid incoming via the supply duct 5 runs successively through the channel 52, the ductile fitting 7 and the inlet orifice 75, to emerge via the oblong hole 74 in the groove 25 in order to spread in the set of channels 24. At the rear end of the segment 2, the fluid runs through the rear groove 23 to come back through the exhaust channels 24' and then runs through the oblong hole 74', the outlet orifice 75', the ductile fitting 7' and the channel 65' to emerge into the exhaust duct 5'.

The ring 6 form thus a fluid distribution box, via ductile fittings 7, 7', between each segment 2 and the ducts, respectively the supply duct 5 and the exhaust duct 5', arranged in the central shaft 1.

Thanks to the invention, this distribution box 6, threaded on the front portion of the central shaft 1 and placed behind the linking member 40, is perfectly protected against possible shocks. However, connection must be guaranteed between this linking member 40 and the control part 3 for the expansion and the retraction of the segments which is composed, as usual, of a tubular sheath threaded on the lateral cylindrical face 13 of the shaft 1 and whereof the length is limited in order to extend only up to the bearing surface 13' for inserting the distribution ring 6, in the forward position of the sheath corresponding to the retraction of the segments.

Figure 2:
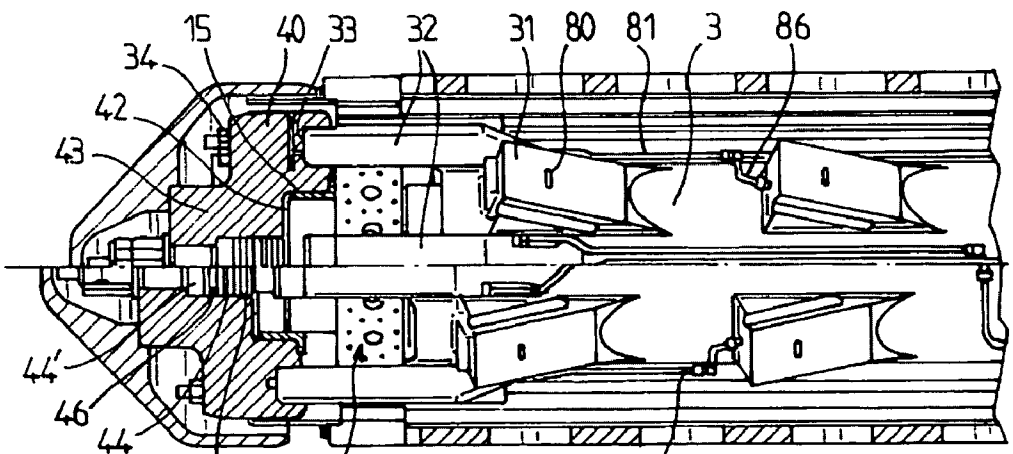
FIG. 2 shows two semi-views in horizontal section along the line II-II of FIG. 1, respectively in expanded and retracted position.

To this end, according to another particularly advantageous characteristic of the invention, the tubular sheath 3 controlling the expansion and the retraction of the segments extends, in its forward position, up to the bearing surface 13' for inserting the distribution ring 6, and is prolonged towards the front, beyond thereof by at least two arms 32 which run each in a space left between two pairs of ductile fittings 7, 7' and prolong each up to the front end 15 of the shaft 1, so that the linking member 40 with the expansion control rod 4 may be attached, by bolts 34, to the front face 33 of said arms 32 (FIG. 2).

Thus, as shown on FIG. 5, in the four-segment embodiment, the tubular sheath 3 is prolonged by four linking arms 32 laid out starwise and centred each on a junction plane P' between two adjacent segments, in order to run between the ductile fittings 7, 7' corresponding to each segment.

Preferably, the linking member 40 is composed of relatively massive a part, in the form of a bell, comprising a central recess 42 which, at least in a rear position of the control rod 4 corresponding to the expansion of the mandrel, is mounted on a centring bearing surface arranged between the front end 12 of the central shaft and the distribution ring 6. As shown on the figures, this centring bearing surface 15' may advantageously be composed of the lateral face of the locking flange 15 of the distribution ring 6.

The central portion 43 of the linking member 40, which forms the bottom of the recess 42, is drilled with a bore 44 wherein is inserted the end 44' of the control rod 4, the latter being prolonged by a bolt 45 fitted with a tightening nut.

Thus, the rod 4 sliding axially in the central shaft 1 and connected to the tubular sheath 3 by the transversal linking member 40 and the arms 32 may control the expansion or the retraction of the mandrel by radial displacement of the segments 2. As already indicated, the whole distribution system of the heat exchanging fluid in the different segments, placed between the front end of the segments 2 and the massive part 40 forming the linking member with the control rod 4 is perfectly protected against the shocks. Moreover, all the members of the fluid circulation system are interconnected, axially, with the central shaft 1 and may be attached sealingly, either to the latter, or to the different segments 2 by means of the ductile fittings 7, 7'. This arrangement enables therefore to guarantee the distribution of the heat exchanging fluid in the different segments with a perfect tightness without using any flexible hoses.

Figure 3:
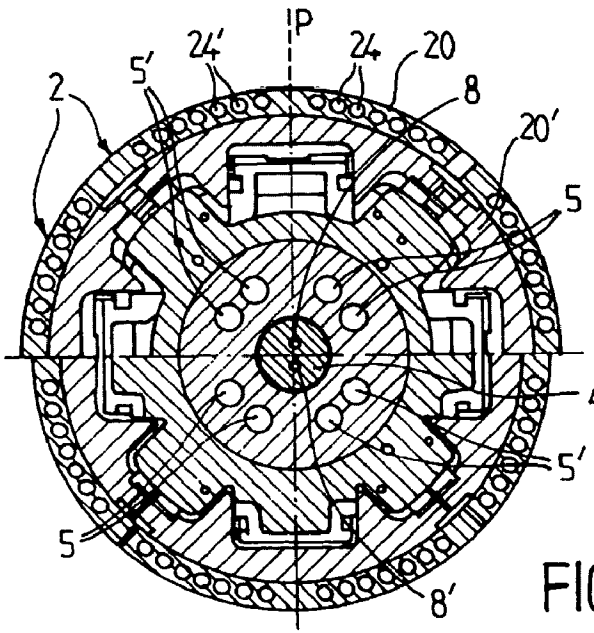
FIG. 3 shows two semi-views in transversal section along the line III-III of FIG. 1.

Indeed, as shown on FIGS. 3 and 5 relative to a four-segment assembly, the central shaft 1 may be drilled, over its whole length, with eight longitudinal bores spaced regularly around the axis and arranged in pairs in order to form, for each segment a supply channel 5 and an exhaust channel 5' extending symmetrically on both sides of the medial plane P of the segment and communicating each, by a transversal channel 52, 52' with a ductile fitting 7, 7' linking with an inlet or outlet orifice, respectively of the fluid, arranged on the connection part 70 of each segment.

Figure 8:
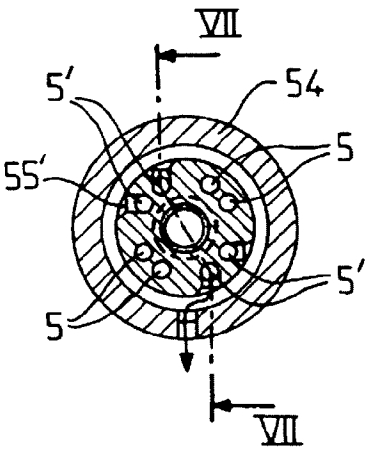
FIG. 8 is a transversal sectional view along the line VIII-VIII of FIG. 7.
Figure 7:
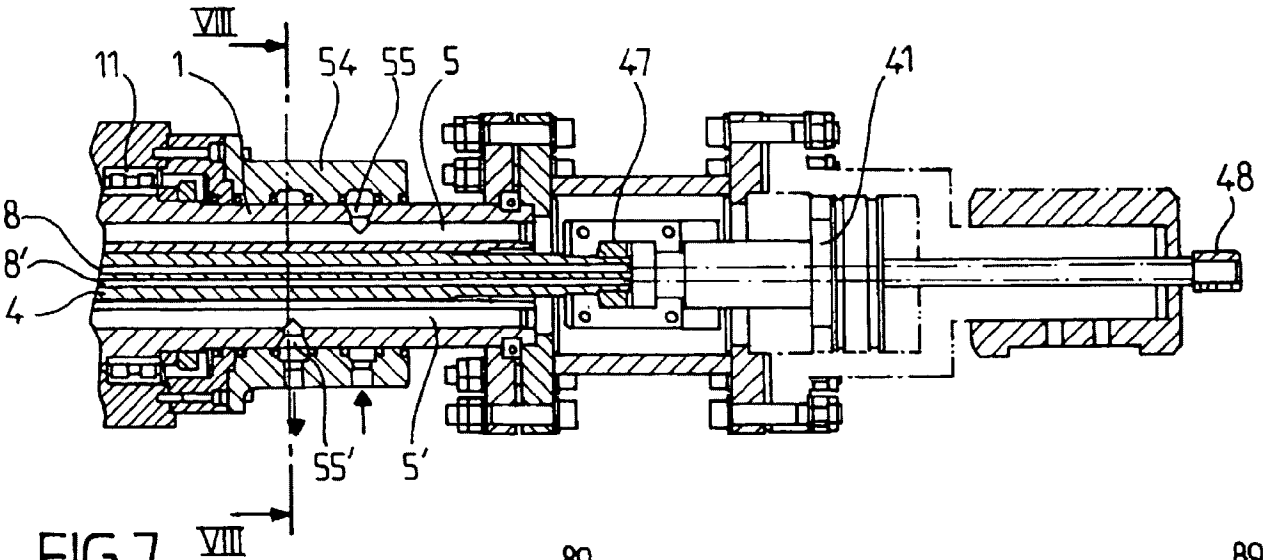
FIG. 7 is a partial view, in longitudinal section, along the line VII-VII of FIG. 8, of the rear end of the central shaft.

As indicated on FIGS. 7 and 8, the supply and the exhaust of the heat exchanging fluid may be performed similarly to the manner described in the previous patent No. 2 761 964, by a revolving seal 54 composed of a socket-shaped part threaded on the rear portion of the shaft 1 and including, on its internal face, two circular grooves connected respectively to fluid supply and exhaust means and communicating, via transversal tubings 55, 55', with the bores forming, respectively, the supply 5 and exhaust 5' channels.

But the arrangement according to the invention also shows other advantages.

First of all, since the fluid distribution system is placed behind the linking member 40, it is possible to provide the front end of the central shaft 1 of the mandrel in order to enable said mandrel to rest transversally on a fixed portion.

Figure 13:
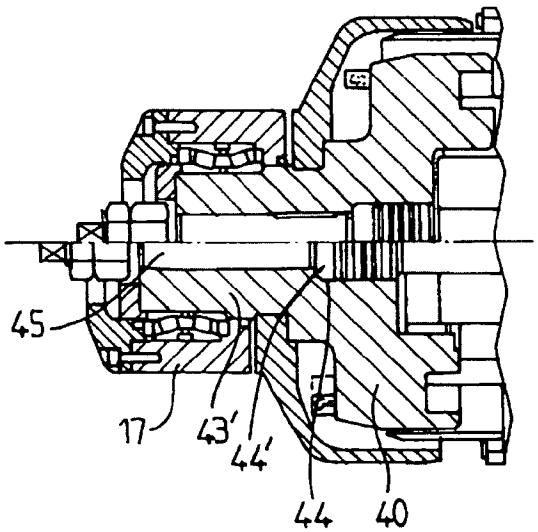
FIG. 13 is a partial view, in longitudinal section, of a variation of the front end of the mandrel.

Indeed, as shown on FIG. 13, the part 40 forming the transversal linking member may be prolonged towards the front by a protruding central portion 43', forming a kind of axle journal whereon may be inserted a bearing 17 through which the shaft 1, which revolves around its axis, may rest on a fixed portion, not represented.

It is thus possible to dispense with the flexion of the shaft under the weight of the coil and, thus, to guarantee contiguous winding of the spires superimposed.

However, if the weight of the coil once wound, as well as the tension applied to the band, are not excessive, the shaft of the mandrel may, as usual, extend cantilever from the supporting chassis 10. In such a case, it is advantageous to cover the front end of the mandrel by a protection cover 26 attached removably to the linking member 40 and extending towards the rear in order to cap the assembly of said linking member 40. Similarly, each segment 2 may be prolonged towards the front by a curved plate 26' having a diameter slightly smaller than that of the cover 26 in order to reach inside said cover with a possibility of longitudinal sliding over the length corresponding to the axial displacement of the expansion control rod 4. There is thus provided a protection cover substantially continuous against dusts or other external nuisances, enabling to prevent pollution of the inside of the mandrel.

But the invention also enables to provide simple and efficiency lubrication of the different portions of the mandrel.

It is necessary, indeed, to lubricate the parts in contact and, in particular, the mating tilted faces 31, 21 which perform the expansion and the retraction of the mandrel. To this end, each tilted face 31 of the sheath 3 is fitted with a grease outlet orifice 80 which, thanks to the invention, may be connected, by means of the linking member 40, to at least one channel 8 arranged over the whole length of the expansion rod 4 and connected to a grease supply means 48, attached to the rear portion of the mandrel.

Figure 6:
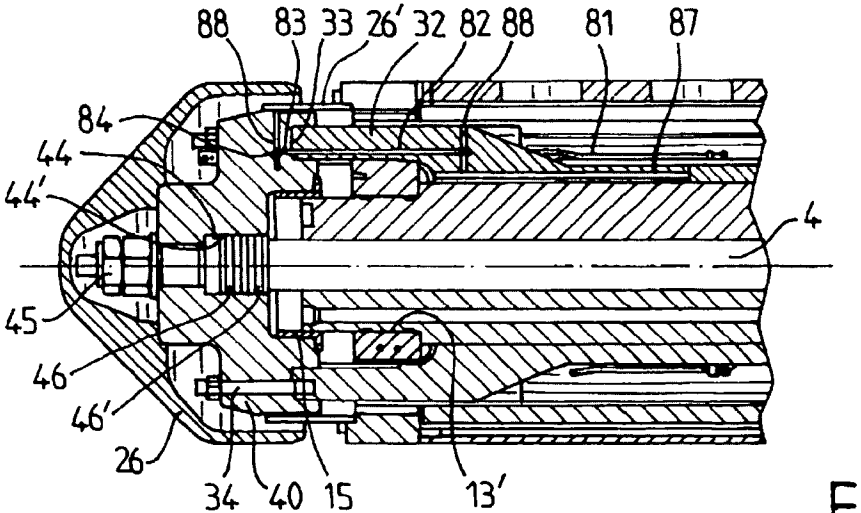
FIG. 6 is another partial view of the front end of the mandrel, in longitudinal section along the line VI-VI of FIG. 5.

As shown in particular on FIG. 1, each grease outlet orifice 80 is situated at the exit of a pipework whereof at least one portion is drilled inside the tubular sheath and may be prolonged at the outside thereof, by a duct 81 extending along the sheath and connecting sealingly to a channel 82 drilled inside a linking arm 32 (FIG. 6) and emerging, on the front face 33 of said arm, through an orifice 83 which, after fastening the linking member 40 on the arms 32 using the bolts 34, is connected sealingly to a tubing 83' arranged on the linking part 40 and emerging onto the rear face thereof.

Figure 10:
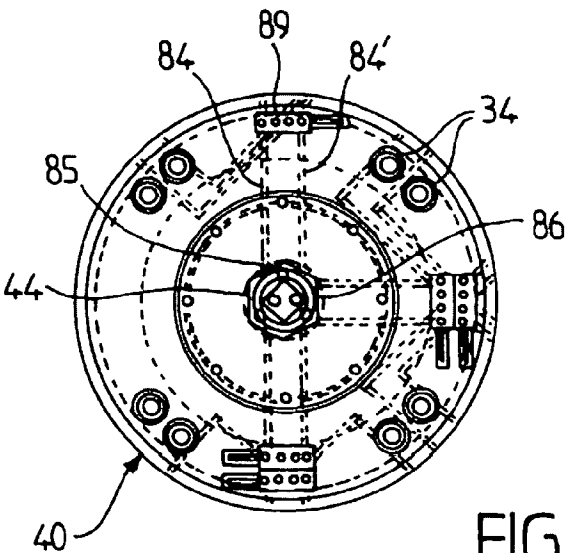
FIG. 10 is a front view of the linking part.
Figure 9:
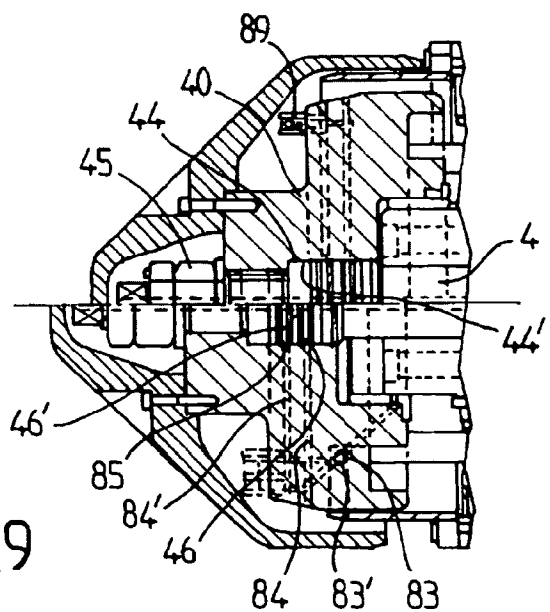
FIG. 9 shows two semi partial views, in longitudinal section, of the front end of the mandrel.
Figure 11:
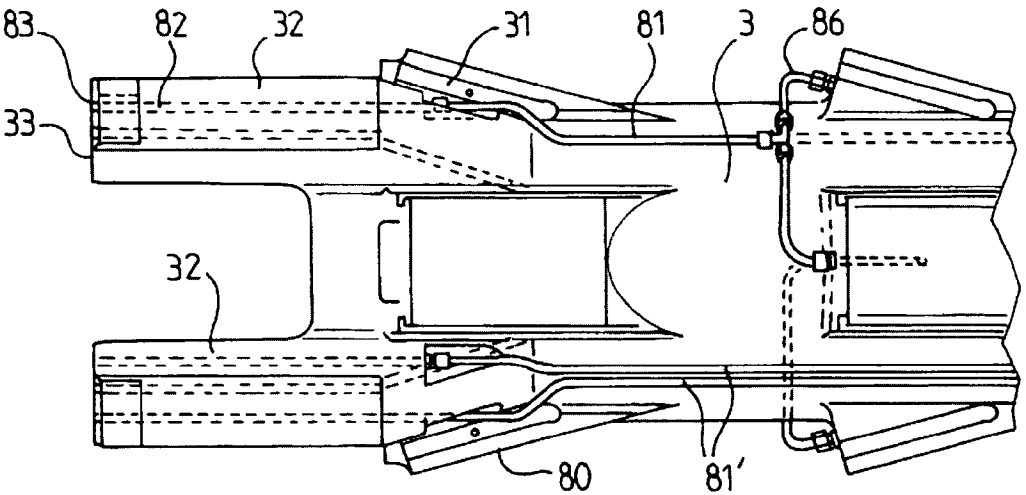
FIG. 11 is a partial view, from beneath, of the tubular control part.

As shown on FIGS. 9 and 10, this tubing 83' is connected by a channel 84 extending radially inside the linking member 40, to a grease infeed orifice 85 opening onto the internal face of the axial bore 44 wherein is inserted the front end of the expansion rod 4 which forms a cylindrical bearing surface 44' whereon is arranged a circular groove 46 which communicates, by a transversal channel, with the supply channel 8 arranged inside the expansion rod 4.

As indicated, the central bore 44 of the linking member 40 forms a countersink enabling to lock the linking member 40 in a fixed position for which the grease infeed orifice 85, opening onto the bore 44, is situated close to the groove 46.

This groove 46 is surrounded by two annular joints in order to provide a watertight pressurised link between the supply channel 8 and the grease infeed orifice 85.

In a known fashion, as shown schematically on FIG. 7, the rear end of the control rod 4 is connected to the stem of the expansion or retraction control jack 41 of the mandrel, by a coupling member 47 which guarantees, moreover, watertight link, by a circuit not represented, with a pressurised grease supply means 48 integral with the jack 41.

Thus, the grease injected through the pipework 8 drilled in the control rod 4 runs through, in succession, the linking member 40 and one of the arms 32 of the sheath to emerge into at least one orifice 80 arranged on at least one tilted face 31.

To control a radial displacement, parallel to itself, of each segment, the tubular sheath 3 includes at least two series of tilted faces 31 centred respectively on two mean transversal planes spaced apart longitudinally and co-operating with at least two series of tilted faces 21 arranged on the internal side of the segment 2.

For example, in the case represented on the figures, the sheath 3 and the segments 2 include three series of tilted faces 31, 21 spaced apart longitudinally. The arrangements according to the invention enable the distribution of the grease, from the same axial channel 8, on the set of the tilted faces 31. Indeed, as shown on FIGS. 9 and 10, a groove 46 communicating with the channel 8 may supply several orifices 85 emerging onto the internal face of the bore 44 and connected each, by a channel 84, to a channel 82 going through an arm 32 and prolonged by a duct 81 which may be composed partially of an external pipework extending along the external face of the sheath 3, between the protruding portions 30 carrying the tilted faces 31. This pipework 81 emerges advantageously into a fork placed at the medial plane of a series of tilted faces to be divided into at least two branches 86 connected each to an outlet orifice 80 arranged on either of the tilted faces 31 of this series. Each arm 32 may, possibly, be drilled with several channels 82 and, for instance, if the sheath 3 is fitted with four arms 32 of the manner represented on the figures, it is easy to distribute a sufficient number of supply ducts on the sheath 3 in order to supply with grease all the tilted faces 31 controlling the expansion or the retraction of the mandrel. Moreover, as shown on the figures, other pipeworks 87, 88 connected to the longitudinal channel 82, may also be arranged in the linking member 40 or the tubular sheath 3 in order to grease other portions of the mandrel.

The arrangement according to the invention also enables to implement a centralised lubrication system of the different portions of the mandrel.

To this end, in the preferred embodiment represented on the figures, the control rod 4 is fitted with two axial channels 8, 8' which communicate respectively with two grooves 46, 46' arranged on the cylindrical bearing surface 44' of the front end of the rod. As shown on FIG. 10, both grooves 46, 46' may supply, respectively, two groups of channels 84, 84' which are connected in pairs to distributors 89 enabling to supply either of both groups of pipeworks 82, 81, 81' arranged in the arms 32 or along the tubular sheath 3 and connected to certain tilted faces 31 of the sheath 3, said faces being thus spread into two groups which may be supplied alternately, thanks to a centralised lubrication system, from either of the supply channels 8, 8', running through the control rod 4.

It should be noted that the lubrication circuits may be provided practically totally by drillings arranged in machined parts and that fittings are dispensed with. Indeed, in the embodiment represented on the drawings, only the rigid pipeworks 81, 86 extend outside the sheath 3, no flexible hoses being necessary to enable the sliding of the sheath and of the segments.

But, another important advantage of the invention lies in the fact that the whole mandrel may be dismantled easily for maintenance purposes or replacing certain parts.

It should be noted, indeed, that the cooling segments 2, which are in contact with the band to be wound, form a kind of wear part, even if they have been designed to hold as long as possible. Consequently, it is advantageous to be able to replace the cooling segments without dismantling the whole mandrel.

To do so, as indicated above, the external flange 71' of each pair of deformable fittings 7, 7' is attached to an intermediate plate 72 which, is itself attached to the connection part 70 of the segment 2 by holding screws 77 which may be withdrawn from the outside. The external portion 20 of each segment 2 may thus be withdrawn and replaced while leaving in place all the other parts of the mandrel, and in particular, the distribution ring 6 and the deformable fittings 7, 7'.

But it is also possible to change the deformable fittings, which are made of a flexible material, such as an elastomer, without needing to dismantle the mandrel.

To do so, it suffices to withdraw the front cover 26 and to unscrew the bolts 45, 34, fastening the linking member 40, respectively to the control rod 4 and to the arms 32, in order to remove the linking member 40 and access the distribution box 6 which may thus be dismantled as a single piece with the four pairs of deformable fittings 7, 7' and the plates 72.

In this view, the machining operations performed at the four corners of the ring 6 enable to maintain and guide said ring between the four arms 32 of the sheath 3 during disassembly, the latter operation being performed in retraction position of the mandrel. Thus, once cleared from the spindle 13', the water box 6 remains held between the arms 32 of the sheath 3. Conversely, during re-assembly, the mandrel is expanded and it is the linking member 40 with the back-up ring 15 which pushes the water box 6 to the smooth bearing surface 13', up to the bottom of the countersink, in a set position for which the orifices of the water circulation systems are aligned.

The assembly composed of the distribution box 6 and of the deformable fittings 7, 7' with the intermediate plates 72 forms therefore a complete mechanical sub-assembly, which can be dismantled in situ simply after removing the linking member 40. A deformable fitting may thus be replaced without needing to remove the whole mandrel.

However, the arrangements according to the invention also enable easy dismantling of the whole the mandrel, in a single operation.

To do so, it suffices, indeed, to remove the axial stops 27 which, as seen above, interconnect axially the segments 2 with the flange 14 of the shaft 1, with a possibility of radial sliding.

After dismantling the front cover 26 and unscrewing the nut connecting the expansion rod 4 to the linking member 40, it is possible to dismantle the whole mandrel, in retracted position, by driving the water box 6 which is enclosed inside the arms 32 of the sheath 3.

Obviously, the invention is not limited to the details of the embodiment which has just been described for exemplification purposes and may be subject to variations using equivalent means, while remaining within the protection framework defined by the claims.

For example, the mandrel might include a different number of segments.

On the other hand, to provide the cooling circuits, it is interesting that each segment 2 includes sufficiently thick a wall to drill therein two series of fluid circulation channels. Still, each segment could also be of welded construction, as described in the previous patent No. 2,761,964, the external wall of the segment comprising two curved plates, respectively internal and external plates, spaced from one another in order to provide a free space divided, by at least one wall parallel to the axis, into at least two chambers, respectively supply and exhaust chambers, which emerge respectively into an inlet orifice and an outlet orifice of the heat exchanging fluid opening onto a connection facet arranged on the internal face of the segment, at an end thereof, and whereon may be plugged two ductile fittings 7, 7'. However, the preferred embodiment described above enables to resists better to high thermal loads to which the segments are exposed.

Figure 12:
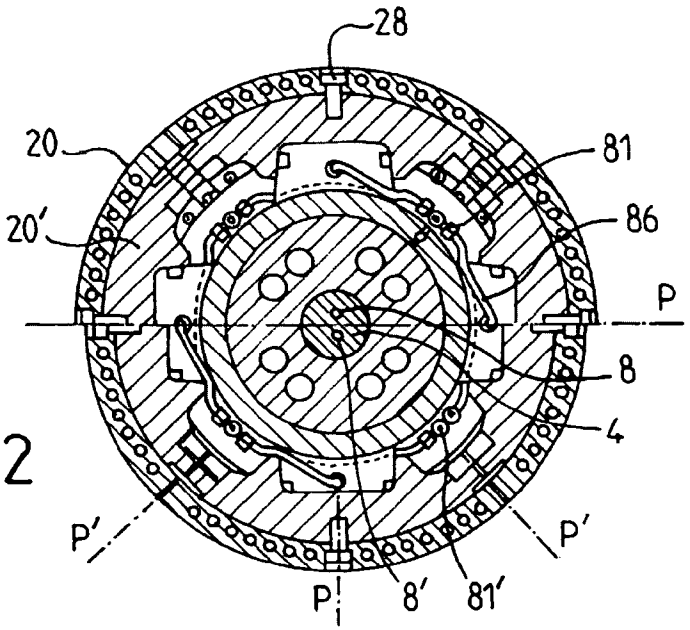
FIG. 12 shows two semi-views in transversal section along the line XII-XII of FIG. 1, respectively in expanded and retracted position.

In particular, as represented on FIGS. 1 and 12, the curved plate 20 forming the external portion of the segment wherein are provided the channels 24, 24' may be attached to the internal portion 20' whereon are arranged the tilted faces 21, by a series of screws 28 placed in the medial axis of the segment and associated to keys 28' which engage in corresponding housings of both portions 20, 20' of the segment, in order to transmit the band tension torque, with a longitudinal clearance allowing dilatation of the segment.

Besides, the realisation of the cooling circuits by bores which may be placed relatively close to the external surface, enables to adjust precisely the extracted thermal flux by varying the water flow rate.

It should also be noted that, if it is particularly advantageous to provide centralised lubrication as described above, the mandrel might also, in a simpler design, be greased manually. In such a case, it would not be necessary any longer to provide the supply channels 8, 8' in the expansion rod 4 but the linking member 40 would still be provided as a drilled block enabling the distribution of the grease through the linking arms 32 of the sheath, the distributors 89 being simply replaced with individual lubrication bars, accessible via simple modification of the front cover 26.

The reference signs inserted after the technical characteristics mentioned in the claims, solely aim at facilitating the understanding thereof and do not limit their extent in any way.

The invention claimed is:

1. A cooled mandrel for winding a band product into a coil, comprising a central shaft extending between a rear end connected to rotational driving means round an axis and a front end, a set of adjacent segments mounted to slide radially on said shaft and having curved external faces which connect to form a substantially cylindrical winding surface centered on the axis of the central shaft, means for controlling a variation in diameter of the winding surface, by radial sliding of said segments between an expanded position and a retracted position, and means for cooling the surface of each segment by circulating a heat exchanging fluid comprising, for each segment, a cooling circuit arranged inside said segment and having an inlet orifice and an outlet orifice of the heat exchanging fluid connected each, by means of a fitting of variable length, to a fluid supply or exhaust duct, respectively, wherein each fluid supply or exhaust duct, respectively is arranged, at least partially, inside the central shaft and fitted, close to the front end thereof, with a bent portion extending transversally to the longitudinal axis and emerging on a lateral face of said shaft via a supply or exhaust transversal orifice, respectively, which is connected sealingly, by at least one fitting of variable length, to at least one inlet or outlet orifice, respectively, of at least one segment.

2. A winding mandrel according to claim 1, wherein the fittings of variable length linking with the inlet and outlet orifices of each segment are attached to a distribution part in the form of a ring having a concave internal face threaded sealingly on a smooth bearing surface of the lateral face of the central shaft, whereon are provided at least two internal orifices which, in the threaded position of the distribution part, are aligned each with a supply or exhaust transversal orifice, respectively, opening onto said bearing surface of the central shaft, in order to form a substantially watertight connection, and an external face whereon are provided, for each segment, two external orifices, respectively supply and exhaust orifices, associated each to a means for plugging a connection fitting on an inlet or outlet orifice, respectively of the corresponding segment, each external orifice, respectively a supply or exhaust orifice, being connected to an internal orifice, respectively a supply or exhaust orifice, via at least one channel arranged, at least partially, in the distribution part.

3. A winding mandrel according to claim 2, wherein it includes, for each segment, a pair of ducts, respectively supply and exhaust ducts, arranged inside the central shaft and emerging respectively, on the lateral face of the shaft, via a pair of transversal orifices, that each pair of external orifices, respectively supply and exhaust orifices, corresponding to a segment is connected by two channels arranged in the distribution part, to a pair of internal orifices, respectively supply and exhaust orifices, and that the pairs of internal orifices corresponding to the different segments are distributed, along the internal face of the distribution part, similarly to the pairs of transversal orifices on the insertion bearing surface of the shaft, so that, in the threaded position of the distribution part, each internal orifice, respectively the supply or exhaust orifice, lies in the extension of a transversal orifice connected to a duct, respectively the supply or exhaust duct, of the central shaft.

4. A winding mandrel according to claim 3, comprising a number (n) of segments having a radial medial plane (P) and extending between two radial junction planes, said radial planes being distributed in a star form around the axis, wherein the central shaft is fitted with (n) pairs of ducts, respectively supply and exhaust ducts, extending symmetrically on both sides of each radial medial plane P and emerging each into the lateral face of the shaft via a transversal orifice having an axis parallel to said radial medial plane (P) and in that the internal orifices and external orifices of the distribution part are distributed by symmetrical pairs with respect to the radial medial plane (P) of each segment and have axes parallel to said radial medial plane and aligned with the axes of each corresponding pair of transversal orifices of the insertion bearing surface of the central shaft.

5. A winding mandrel according to any one of claims 2, 3 and 4 wherein the lateral face of the central shaft and a mating internal face of the distribution part are in the form of cylinders whereof the revolution is centered on the axis of the central shaft and having the same diameter, within the assembly clearance, and that the distribution part is mounted slidingly on the insertion bearing surface of the shaft with interposition of at least two annular sealing joints, on both sides of the aligned orifices.

6. A winding mandrel according to claim 5, wherein the external face of the distribution part includes a plurality of connection facets, whereof the quantity is equal to the number (n) of segments, fitted each with a pair of external orifices, respectively supply and exhaust orifices, connected to a pair of orifices, respectively inlet and outlet orifices, of the corresponding segment, by a pair of fittings of variable length having each an internal end and an external end attached respectively to a facet of the distribution part and on a connection facet of the segment whereon are provided the inlet and outlet orifices of the fluid.

7. A winding mandrel according to claim 6, wherein the ends, respectively internal and external ends, of the fittings of each pair are attached respectively on the connection facets of the distribution part and of the segment, by two plates forming respectively an internal flange and an external flange.

8. A winding mandrel according to claim 7, wherein the external flange for fastening is each pair of fittings on each segment is attached to an intermediate plate attached itself to the connection facet of the segment by screws engaging from the outside.

9. A winding mandrel according to any one of claims 2, 3 and 4 comprising a number (n) of segments and wherein the central shaft extends between a rear portion connected to means for driving said shaft into rotation round its axis, and a front portion for supporting the segments, wherein the radial sliding of the segments is controlled by a rack-device comprising a tubular sheath mounted to slide axially on the front portion of the central shaft and whereon are arranged at least (n) faces tilted with respect to the axis, co-operating each with a mating tilted face of a corresponding segment, for controlling, respectively, the expansion or the retraction of the mandrel by sliding the sheath between two positions, respectively a retracted position and an extended position, under the action of a control rod mounted slidingly parallel to the axis of the central shaft and prolonged beyond a front end thereof in order to be attached to a linking member with the tubular sheath, extending transversally before the front end of the central shaft.

10. A winding mandrel according to claim 9, wherein the tubular sheath mounted slidingly on the central shaft extends substantially, in its forward position, up to the bearing surface for inserting the distribution part, and is prolonged, beyond the latter, by at least two arms running each between two pairs of connection fittings between the distribution part and both corresponding adjacent segments, each arm being attached, by a front end, to the transversal member linking with the sliding control rod.

11. A winding mandrel according to claim 10, comprising (n) segments surrounding the central shaft, wherein the distribution part comprises (n) watertight connection facets, each of a pair of connection fitting, between which are arranged (n) slipping faces forming each a sliding rest for an arm controlling the tubular sheath.

12. A winding mandrel according to claim 11, wherein the external face of the distribution part has a polygonal shape, the connection facet of the fittings being planar.

13. A winding mandrel according to claim 10, wherein the transversal linking member between the control rod and the sheath is composed of a massive part, fitted with a central recess which, at least in a rear position of the control rod, is mounted on a centering bearing surface, arranged between the front end of the central shaft and the insertion bearing surface of the distribution part.

14. A winding mandrel according to claim 13, wherein, the control rod being mounted slidingly in an axial bore of the central shaft, the central recess of the transversal linking member, is closed towards the front by a bottom whereon is attached the front end of the control rod.

15. A winding mandrel according to claim 14, wherein the linking member is prolonged, towards the front, by a protruding portion forming a axle journal centered on the axis of the central shaft and liable to rest, by means of a bearing, on a fixed portion.

16. A winding mandrel according to claim 9, further comprising a protection cover, attached removably to the linking member and extending towards the rear, in order to cap the assembly thereof.

17. A winding mandrel according to claim 16, wherein each segment is prolonged towards the front by a curved plate having a diameter slightly smaller than that of the cover in order to reach thereinside with a possibility of longitudinal sliding to form a substantially continuous protection.

18. A winding mandrel according to any one of claims 2, 3 and 4, wherein each segment comprises an internal portion supporting means controlling the radial sliding and an external portion in the form of a cylindrical sector, of welded construction and comprising two curved plates, respectively internal and external, spaced apart from one another in order to provide a free space divided, by at least one wall parallel to the axis, into at least two chambers, respectively supply and exhaust chambers, wherein emerge, respectively, an inlet orifice and an outlet orifice of heat exchanging fluid, arranged in the internal plate of the segment, at an end thereof, said chambers being communicated at the other end of the segment.

19. A winding mandrel according to any one of claims 2, 3 and 4, wherein each segment comprises an internal portion supporting means controlling the axial sliding and an external portion in the form of a cylindrical sector, composed of a curved plate in the thickness whereof are provided a plurality of channels parallel to the axis of the mandrel and distributed over the whole surface of the segment in two series, respectively a supply series and an exhaust series, emerging each, at a front end of the segment, into a distribution chamber integral with the segment and fitted with an inlet orifice or an outlet orifice, respectively of the fluid, the channels of both series being connected to one another, at a rear end of the segment, by a common distribution chamber.

20. A winding mandrel according to claim 10, comprising a number (n) of segment and wherein each arm controlling the sliding of the sheath is attached, by a front end, to a rear face of the transversal member linking with the control rod, charactericed in that wherein it includes a circuit for lubrication, at least, tilted faces controlling the sliding of the segments comprising, for each tilted face, at least one grease outlet orifice, situated at the exit of a pipework extending along the sheath and prolonged by a portion along at least one arm controlling the sliding up to a supply orifice placed on the front end of said arm and connected, by fastening the linking member on said arm, on a watertight connection tubing, carried by the linking member, and connected to a pressurised grease infeed means.

21. A winding mandrel according to claim 20, wherein each connection tubing of the lubrication circuit is arranged on a rear face of the linking member, whereon applies the front end of the corresponding control arm of the sheath and is placed at the exit of a conduit extending, at least partially, inside the linking member, up to a grease infeed orifice.

22. A winding mandrel according to claim 21, wherein the control rod is centered on the axis of the mandrel and attached, by a front end on a transversal part forming the linking member with the sheath, wherein the front end of the control rod is fitted with a cylindrical bearing surface which is inserted into a mating bore arranged at the center of the linking member and wherein emerges at least one grease inlet orifice connected by a conduit to the connection tubing carried by the linking member, and that the control rod is fitted with at least one channel extending longitudinally between a rear orifice connected to the grease infeed means and a front orifice arranged on the insertion bearing surface of the control rod, and communicating with the grease inlet orifice emerging into the bore of the linking part, after inserting the control rod therein.

23. A winding mandrel according to claim 22, wherein the bearing surface for inserting the control rod is fitted with at least one groove which, in the inserted position of the control rod, is situated by the grease infeed orifice opening onto the central bore, said groove being surrounded by two annular sealing joints.

24. A winding mandrel according to claim 20 further comprising at least two series of tilted faces controlling the radial displacement, respectively, of each segment, centered on two mean transversal planes spaced apart longitudinally, each segment being associated with a face of each series, wherein the lubrication circuit comprises, for each series of tilted faces, at least one pipework extending along a control arm, from a supply orifice placed on the front end of said arm up to a fork placed at said series of tilted faces, from which said pipework is divided into at least two branches emerging each into an outlet orifice arranged on one of the tilted faces of said series.

25. A winding mandrel according to claim 22, wherein the tilted faces controlling the radial sliding of the segments are distributed into at least two groups associated each a lubrication circuit, that the control rod is fitted with at least two longitudinal channels. emerging each into a groove of the insertion bearing surface, that the central bore of the linking part is fitted with at least two groups of orifices coinciding, in the inserted position, each with a groove of the insertion bearing surface, and connected each to a connection tubing, that and wherein the tubular sheath carries at least two groups of pipeworks associated respectively with said groups of tilted faces, each pipework extending along a control arm, from a supply orifice connected to one of the connection tubings, up to at least one grease outlet orifice emerging into at least one tilted face of the corresponding group, and wherein the mandrel is associated with a centralised lubrication system for controlling the pressurised introduction of grease, alternately, in either duct of the control rod and the lubrication of either group of tilted faces.

* * * * *